United States Patent [19]

Thompson

[11] 4,430,597

[45] Feb. 7, 1984

[54] AMBIENT PRESSURE LAMP

[76] Inventor: William E. Thompson, R.R. 1, Box 89, Middletown, Ind. 47356

[21] Appl. No.: 280,112

[22] Filed: Jul. 2, 1981

[51] Int. Cl.[3] ..... H01K 1/18; H01K 1/34; H01K 1/52

[52] U.S. Cl. ..... 313/113; 313/148; 313/275; 313/552

[58] Field of Search ..... 313/113, 148, 552, 545, 313/275

[56] References Cited

U.S. PATENT DOCUMENTS

| | | | |
|---|---|---|---|
| 2,901,654 | 8/1959 | Myers | 313/113 |
| 3,898,451 | 8/1975 | Murphy et al. | 313/113 X |
| 4,310,772 | 1/1982 | Tyler et al. | 313/113 |
| 4,317,061 | 2/1982 | Mendelsohn | 313/148 X |

*Primary Examiner*—Palmer C. Demeo

*Attorney, Agent, or Firm*—Woodard, Weikart, Emhardt & Naughton

[57] ABSTRACT

An ambient pressure lamp for automobiles and related conveyances includes a parabolic reflector having an inner reflective surface, an outer surface, a base portion and an outer peripheral edge wherein the base portion includes a centrally located clearance aperture for receipt of a lamp filament socket. The reflector member is enclosed by a lens member which as a stepped inner surface and a surrounding lip portion which is sealingly attached to the outer peripheral edge of the reflector member in order to define an inner chamber wherein a lamp filament is positioned. An expandable membrane is sealingly joined around the outer surface of the reflector member and around the lamp filament socket so as to define an expansion chamber between the outer surface and the membrane. This expansion chamber is completely enclosed except for being in flow communication with the inner chamber so that as pressure increases result due to the heating of the filament and heating of the internal atmosphere within the inner chamber, the expandable membrane stretches outwardly in order to provide an increased volume so that the internal pressure within the lamp remains at an ambient level regardless of the operating status of the lamp. The lamp filament socket includes purge and fill passageways so that the inner chamber and the expansion chamber can be purged of all oxygen and moisture and filled with an inert gas mixture.

10 Claims, 7 Drawing Figures

AMBIENT PRESSURE LAMP

BACKGROUND OF THE INVENTION

The present invention relates in general to vehicle headlamps and in particular to the type of headlamp which has a parabolic reflector and cover lens.

Conventional vehicle headlamps typically include some type of filament, a parabolic reflector base and a molded lens sealed thereto in order to create an evacuated chamber. The atmosphere of this evacuated chamber surrounds the filament and the operational characteristics of the lamp (i.e., average life and candlepower) are directly influenced by the nature of this inner atmosphere.

In this inner atmosphere is not evacuated to a level sufficiently below one atmosphere when at "room temperature," then as the filament conducts current and heats the interior of the evacuated chamber, the gases filling this chamber expand to an excessive pressure level. While one solution to this potential problem is to evacuate the inner chamber to a lower pressure level, this option is offset by the fact that some inner atmosphere is needed in order to provide a suitable heat conductor surrounding the filament. The choice between the two "solutions" becomes a compromise in lamp construction wherein the initial chamber atmosphere is evacuated to a pressure level low enough to permit expansion to an allowable inner pressure when the lamp is at maximum operating temperature.

A related concern to that of an evacuated inner chamber is the need to void the interior of moisture and seal therewithin the particular gases selected for the interior atmosphere. The greater the pressure difference between the inside and outside atmospheres, the greater will be the demands placed upon the seal locations, and consequently, the more susceptible the assembly will be to leakage and thus failure.

One means to improve upon the foregoing problems is provided by the present invention wherein an expandable membrane is arranged in cooperation with the inner chamber of the lamp in order to accommodate volumetric expansion during operation. The membrane serves as an interface between two atmospheres of equal pressure. Although there is a variety of known prior patents which pertain to lighting and lamps, no reference is known to exist which reveals any concept that is related to the expandible membrane concept of the present invention.

A related aspect of the present invention pertains to the design of the filament and the use of a ceramic glow bar in order to increase the luminance and candlepower of the source. While glow bar concepts are known to exist, the present invention provides a design which is a practical, high production means of fabrication, its actual configuration, and its combined use with the disclosed ambient pressure lamp incorporating the expandable membrane.

Listed below are various patent references which are known to the inventor and which disclose lamp designs and related concepts. Consequently, these references may be relevant to the present invention, but none of the references are anticipatory of the present invention nor render the present invention obvious.

| Pat. No. | Patentee | Issue Date |
|---|---|---|
| 1,406,645 | Heany | 2/14/22 |
| 1,640,829 | Heany | 8/30/27 |
| 1,749,136 | Heany | 3/04/30 |
| 1,975,499 | Braselton | 10/02/34 |
| 2,007,926 | Braselton | 7/09/35 |
| 2,901,654 | Myers | 8/25/59 |
| 4,032,809 | Corth | 6/28/77 |
| 4,146,812 | Gagnon | 3/27/79 |
| 3,027,481 | Baber et al. | 3/27/62 |
| 2,950,413 | Jayne et al. | 8/23/60 |
| 2,007,945 | Harding, Jr. | 7/09/35 |
| 1,623,761 | Skaupy | 4/05/27 |
| 2,273,762 | Reerink et al. | 2/17/42 |

Heany ('645) discloses an incandescent electric lamp having a particularly styled filament. The filament includes a first helical coil of refractory metal disposed over a refractory compound. Additionally, there is a second coil providing an outer layer of turns disposed over a second layer of a refractory compound. To the extent that this particular invention pertains primarily to the construction and materials of the filament, it may have some relevancy to the present invention. Otherwise, the remainder of the lamp is in no way relevant.

Heany ('829) discloses an incandescent electric lamp, and in some regard similar to the first Heany reference, the invention focuses almost totally on the construction of the filament. In particular, a large number of arrangements are disclosed, all relating to the disposition of a tungsten coil relative to a refractory compound which supports the coil and possesses great strength at the operating temperature and is capable of becoming highly incandescent at the operating temperature of the lamp.

Heany ('136) discloses an incandescent electric lamp, again of the same basic idea and concepts of the earlier two Heany references. Here again, the invention focuses almost totally on the design and construction of the filament and the relationship of the tungsten coils to the refractory compound.

Braselton ('499) discloses a constant illumination electric lamp wherein the main thrust of the invention pertains to the arrangement of the filament which, in this case, is disposed between two support rods and includes a filament coil disposed around a rod of refractory metal and between the two support rods.

Braselton ('926) discloses a light-emitting unit wherein four support rods are provided and two coils. The two coils are arranged in a double-coil design such that two of the support rods support one coil and the other two support rods support the other coil. Both coils are disposed about a core of electron-emitting material in order to provide the desired illumination and candlepower for the light-emitting unit. Again, this particular invention pertains almost totally to the design and construction of the filament.

Myers discloses an electric incandescent lamp of the self-contained reflecting type which is adapted to project a beam of light. Additionally, the invention pertains to improvements in lamps of this type which are shatter-proof and to techniques for fabricating such lamps. The lamp assembly includes a Mangin mirror which is secured at its periphery to one end of a cylindrical metal shell. The other end of the shell is enclosed by a transparent window plate in order to form an evacuated chamber which contains the light-emitting element. The shell is constructed with inwardly turned edges in order to form a bellows-type of configuration at which point it provides a glass-to-metal seal. The fact that this shell is formed of a durable metal eliminates any suggestion or possibility that the interior volume is permitted to expand outwardly by expansion of the shell.

Corth discloses a coiled incandescible filament which principally comprises tantalum carbide and which has coiled end portions overfitting relatively thick tantalum carbide members. The inner surfaces of the overfitting coils are welded to the relatively thick members. Electrical connection and support for the filament is made to the relatively thick, overfitted members, rather than the fine, brittle filament.

Gagnon discloses a motor vehicle headlight which includes a curved reflector having a lens bonded to the front thereof and a tungsten-halogen capsule disposed within the reflector. A filling hole extends through the rear of the reflector and this hole is hermetically sealed by means of a nonrigid sealing material.

Baber et al. discloses in general a projection lamp and in particular to incandescent lamps that may be used in various devices utilizing an optical system in the projection of slides, motion picture films, or other types of transparent or semi-transparent objects. In particular, the lamp disclosed is intended to be acceleration and vibration-resistant and includes a filament in the form of a pair of semi-circular segments which are carried and supported by a generally cylindrical support element which in turn is held in position relative to the lamp by a plurality of rod-like supports.

Jayne et al. discloses a filament connection for electric lamps and similar devices and in particular relates to the connection between the filament and the leading end conductors. Although the patent discloses some specifics regarding the filament design, the primary nature of the invention is the connection concepts which are disclosed.

Harding, Jr. discloses an electric lamp with a concentrated light source and includes a pair of support rods holding a filament. The filament constitutes the primary aspect of the invention and is disclosed as including a cylinder of refractory material which is provided with a helical groove and an electron-emitting element which is made into a coil form and wound into the grove.

Skaupy discloses an electric glow lamp design wherein the support element which is normally made of refractory material is made of transparent material which will convey sufficient heat to the light-giving element mounted thereon in order to make the element luminous, yet the body in which the element is mounted does not interfere materially with the radiation of the light-giving element thereby enabling the light-giving element to stand out. This particular patent reference is believed to have very limited applicability to the present invention.

Reerink et al. discloses an incandescible cathode construction wherein one or more thin metal wires is wound around a metal core made of refractory material in order to form a structure in which a comparatively large mass and large area of a highly electron-emissive substance surrounds the core and is securely retained by the turns and/or layers of the thin wire. The purpose of this particular invention is to generate a very large emitting surface that can be provided on the cathode with an ample supply of emissive substance, which substance at the same time firmly adheres to the cathode.

A concept related to the invention of an ambient pressure lamp is the ability to reconfigure the front lens. When there is an internal pressure within the lamp, a convex outer lens is preferred from the standpoint of overall strength. In order to fabricate this convex shape, a molded glass construction is typically employed; but a plastic lens cemented to a reflector is one option. One drawback with the use of such plastic is the fact that it is more susceptible to the elements of weather and to chemicals. Once the plastic is scratched or begins to deteriorate due to the chemicals, light transmission is reduced.

One solution to this drawback is to use a lens with a flat outer surface and to fabricate this outer surface of a more durable material such as, for example, a thin overlay of glass. An inner layer of plastic can still be used for lens focusing, but a flat layer of glass on the outer surface provides the needed protection from the elements and chemicals. The fact that the interior of the lamp is at ambient pressure permits the use of a flat lens because the strength requirements for the lamp are greatly reduced since the internal lamp pressure of the present invention equals the external ambient pressure.

SUMMARY OF THE INVENTION

An ambient pressure lamp for automobiles and related conveyances according to one embodiment of the present invention comprises a reflector member having an inner reflective surface, an outer surface, a base portion and an outer peripheral edge, an enclosing cover member having an outer peripheral lip portion, the lip portion being assembled to the outer peripheral edge so as to define an inner chamber between the inner reflective surface and the enclosing cover member, a lamp filament, a filament socket assembled to the reflector member adjacent the base portion and cooperatively adapted for receipt of the lamp filament, and an expandable membrane sealingly joined around the outer surface and around the filament socket so as to define an expansion chamber between the outer surface and the expandable membrane, the expansion chamber being completely enclosed except for being in flow communication with the inner chamber.

One object of the present invention is to provide an improved headlamp of lower cost.

Related objects and advantages of the present invention will be apparent from the following description.

DESCRIPTION OF THE PREFERRED EMBODIMENT

Figure 1:
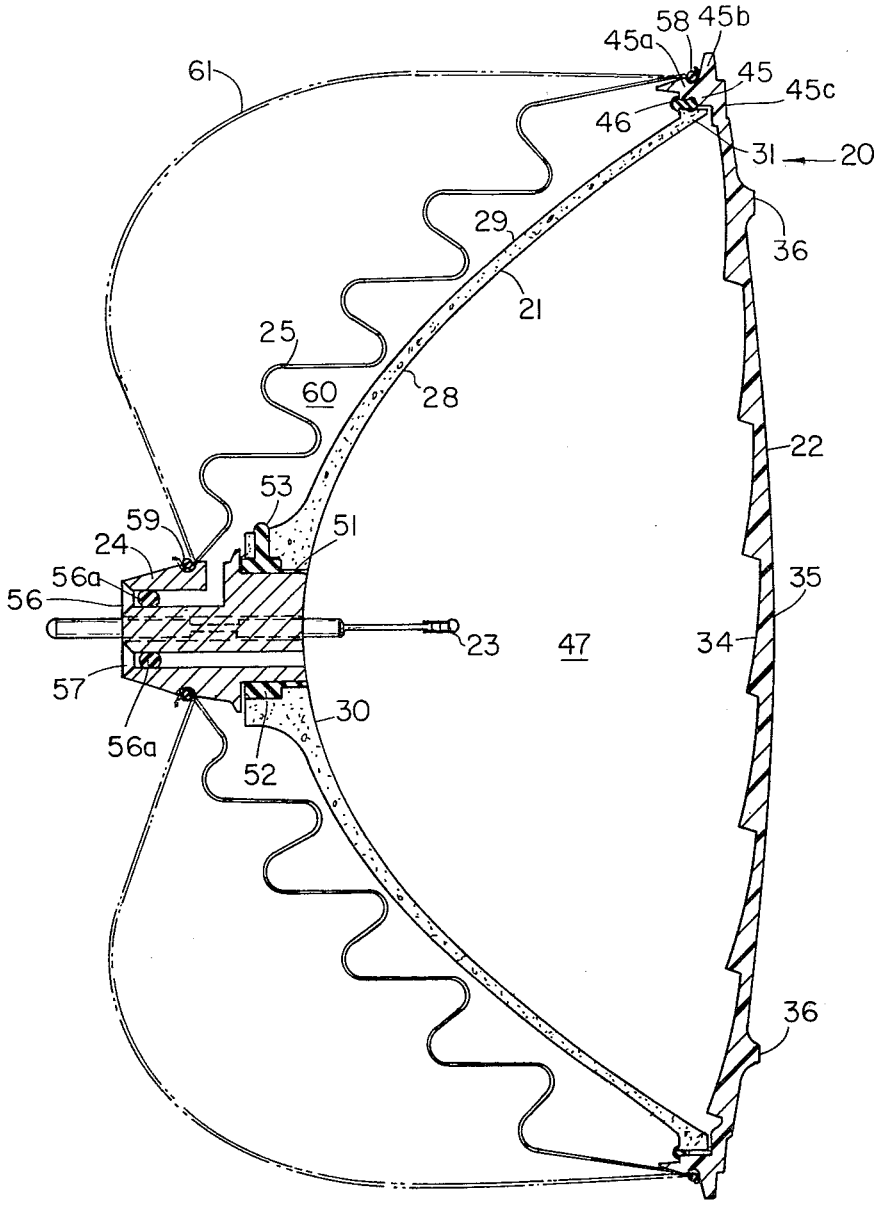
FIG. 1 is a side elevation section view of an ambient pressure lamp according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a side elevation view in full section of an ambient pressure lamp 20 which includes parabolic reflector 21, lens 22, filament 23, filament socket 24 and expandable membrane 25.

Figure 7:
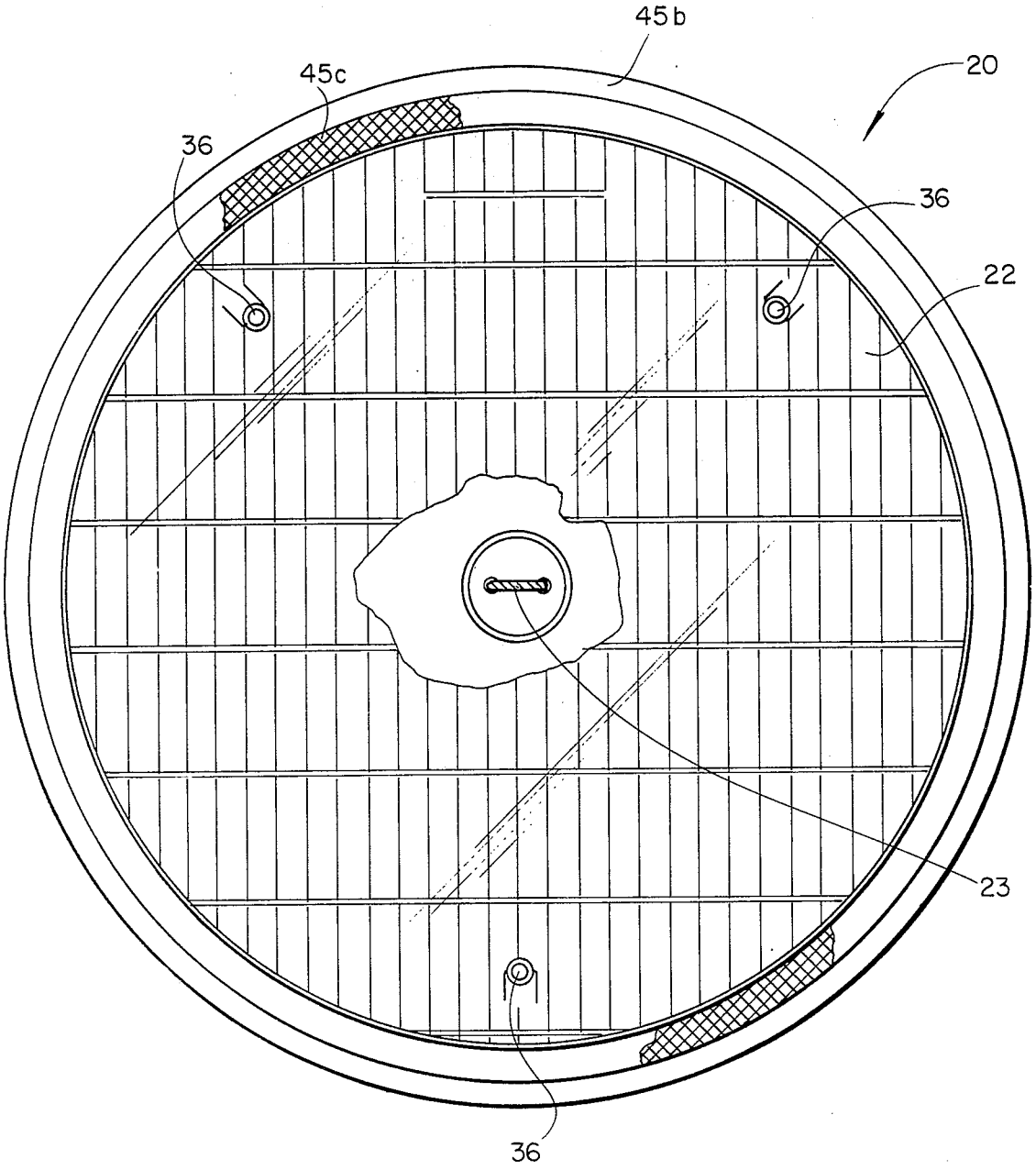
FIG. 7 is a front elevation view of the FIG. 1 ambient pressure lamp as well as of the FIG. 6 ambient pressure lamp.

Parabolic reflector 21 includes an inner reflective surface 28, an outer surface 29, a base portion generally defined at 30 and an outer peripheral edge 31 which is circular in shape (see FIG. 7). Reflector 21 is constructed of cast plaster material and then surface 28 is coated with a high-gloss paint and thereafter aluminized. Lens 22 is generally convex in cross-sectional configuration having a stepped internal surface 34 and a substantially smooth outer surface 35. Disposed on outer surface 35 are three aiming nodes 36 which are provided in order to establish a flat reference plane for establishing the proper centering and squareness of the lamp. Lens 22 is molded of a polycarbonate plastic and may include certain surface coatings to improve abrasion resistance.

Figure 2:
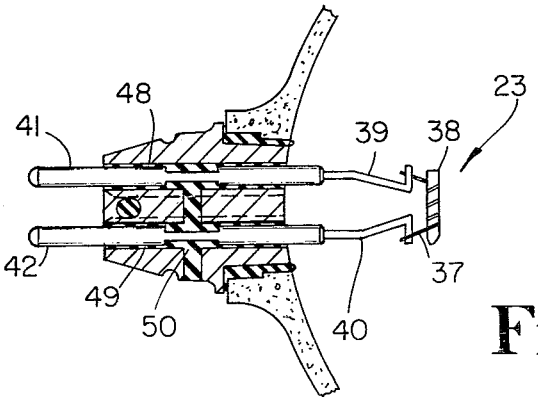
FIG. 2 is an enlarged detail top plan view in section of a socket and filament subassembly comprising a portion of the FIG. 1 ambient pressure lamp.
Figure 3:
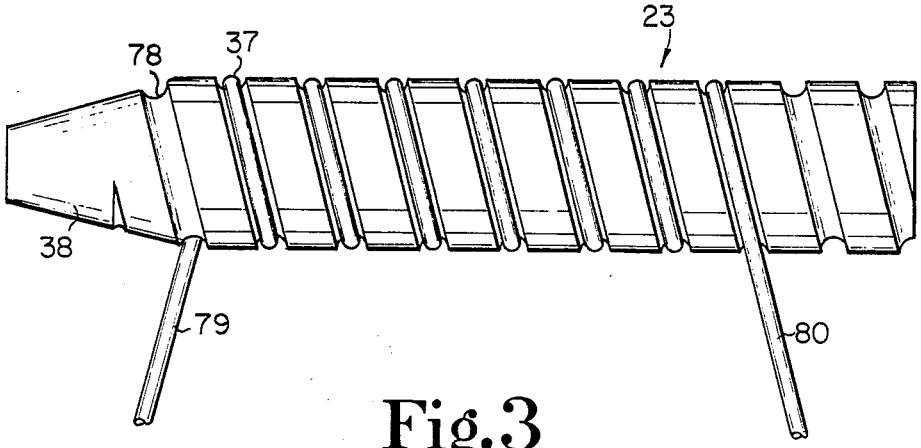
FIG. 3 is an enlarged detail front elevation view of the filament of the FIG. 2 filament subassembly.

Filament 23 is described in greater detail in FIGS. 2 and 3 and includes a tungsten wire 37 coiled about a non-metallic refractory core 38. The opposite free ends of the tungsten wire are each supported by support rods 39 and 40 which are joined to contact prongs 41 and 42, respectively. Rods 39 and 40 are first assembled to prongs 41 and 42 and this subassembly is then secured to socket 24 in a fixed position.

Lens 22 includes an outer peripheral lip portion 45 which is configured in an overlapping style so as to fit over and around outer peripheral edge 31 of the parabolic reflector 21. Lip portion 45 includes an overlapping area **45*a*, an outwardly extending area 45*b* which provides the mounting means to the vehicle, and retro-reflector band 45*c*, which is annular in shape (see FIG. 7). Band 45*c* makes use of an otherwise lost area and is particularly helpful to oncoming vehicles when one headlamp is out. The annular shape outlines the lamp and permits on-coming drivers to orient themselves relative to vehicles with only one lamp. Lip portion 45 and edge 31 are sealingly joined together by compound 46 which is placed at four locations around this circular interface and the assembly defines an inner chamber 47 which constitutes the interior of lamp 20. Compound 46** provides the means for support of the reflector and socket by the lens.

Filament socket 24 includes a air of in-line passageways 48 and 49 into which contact prongs 41 and 42 are slidably inserted. A crossing passageway 50 is provided for a retaining compound in order to secure the two contact prongs in a desired orientation.

Although the geometry and dimensions of the parabolic reflector 21, filament socket 24 and filament 23 are such that these component parts assemble together in a very accurate and precise manner, there is still some variation both as to geometry and dimensions which require that the placement of the filament be adjustable so as to place the center of luminance of the filament at the focal point of the parabolic reflector. As can be appreciated from the FIG. 2 illustration, each contact prong has a reduced diameter central portion around which a retaining compound is injected via passageway 50 thereby locking the two contact prongs in a fixed location relative to the socket. Once the subassembly of rods, prongs and the socket is completed, there is the opportunity for adjustment of the filament socket 24 relative to the parabolic reflector as can be appreciated by the sliding receipt of the filament socket by clearance aperture 51 which is centrally disposed within base portion 30. The separation existing between clearance aperture 51 and filament socket 24 is filled with a retaining compound 52 which is inserted through port 53.

Socket 24 also includes two purge and fill passageways 56 and 57. These two passageways are each adapted with a conical port in order to permit filling and evacuating with dry nitrogen via adapted nozzles. As dry nitrogen is added and then evacuated, oxygen and water are purged from inner chamber 47 (as well as chamber 60). Once all oxygen and moisture are removed, chamber 47 and the collapsed portion of chamber 60 are filled with a mixture of inert gases, such as an argon-nitrogen mixture. This purging and filling is accomplished by a series of filling and evacuation steps ultimately concluding with inner chamber 47 being filled with an inert gas mixture at one atmosphere. As the purge and fill nozzles are removed from passageways 56 and 57, a sealing compound **56*a* is injected thereby closing off the passageways and sealing closed chambers 47 and 60**.

Expandable membrane 25 is sealingly attached to and around outer peripheral lip portion 45 at sealing point 58 and to and around filament socket 24 at sealing point 59. The two sealing points may be enhanced by providing an O-ring groove and a tightly fitted O-ring at each location. The result of that construction is that outer surface 29 of parabolic reflector 21 in combination with expandable membrane 25 define an expansion chamber 60 which is completely enclosed except for being in flow communication with inner chamber 47 via the clearance spaces left between edge 31 and lip portion 45 (i.e., those areas not receiving retaining compound 46).

Consequently, when filament 23 conducts current and heats up which in turn increases the temperature of the atmosphere (and inert gases) within inner chamber 47, the volumetric expansion of the gases is accommodated by being permitted to flow into expansion chamber 60. This volume increase causes expandable membrane 25 to expand outwardly to a configuration similar to that illustrated by phantom line 61. Clearly, the degree of volumetric expansion and the extent of pressure increase directly influence the degree of expansion of expandable membrane 25. Membrane 25 is constructed of a high-density, substantially impermeable, but thin-walled elastomeric compound. Phantom line 61 represents what is likely the maximum degree of expansion based upon normal operating conditions and temperature increases to be expected upon the energizing of filament 23.

Purge and fill passageway 56 communicates directly with expansion chamber 60 while purge and fill passageway 57 communicates directly with inner chamber 47. In this manner, both chambers can be purged of oxygen and water and sufficient inert gas mixture placed within inner chamber 47 to position the diaphragm so as to allow for both expansion and contraction of the gas. The result of this construction is an arrangement wherein the interior atmosphere of the lamp coincides accurately to the pressure of the outside atmosphere. This greatly minimizes, if not completely reduces, any pressure differences existing between the interior portions of the lamp and the outside atmosphere. This pressure balance reduces sealing requirements and maximizes the conductive nature of the inside atmosphere. The result is an improved lamp which can be described as an ambient pressure lamp.

Figure 6:
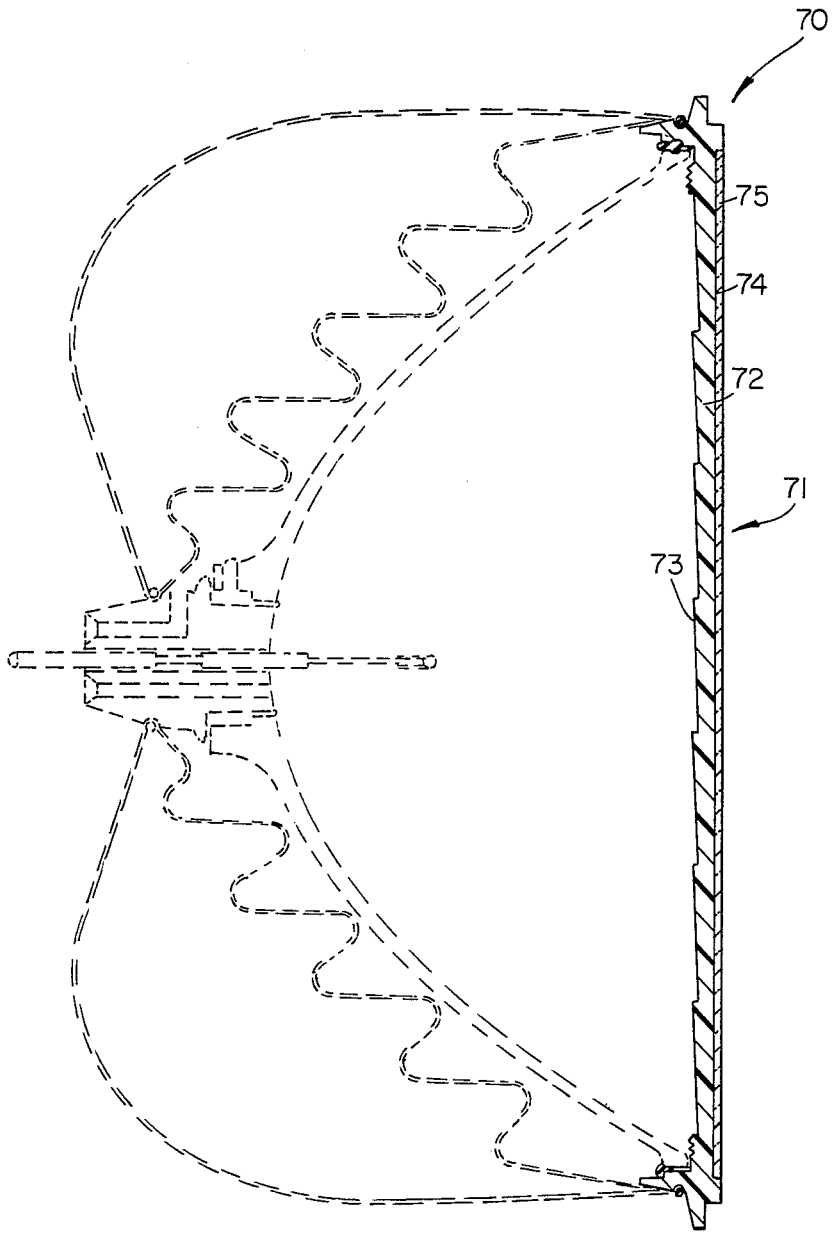
FIG. 6 is a side elevation section view of an ambient pressure lamp according to a typical embodiment of the present invention.

Referring to FIG. 6, the general design and construction of ambient pressure lamp 20 is illustrated in phantom form with the one change illustrated in solid line form, that one change being a revised lens construction. Ambient pressure lamp 70 includes virtually the same construction as to the parabolic reflector portion, the filament, the filament socket and the expandable membrane. The difference between ambient pressure lamp 70 and the previously described ambient pressure lamp 20 pertains to the design and construction of lens assembly 71. Lens assembly 71 includes a substantially flat lens member 72 having a stepped inner surface 73 and a substantially flat outer surface 74. Lens assembly 71 further includes a substantially flat glass cover plate 75 which is received by and securely joined to the flat outer surface 74 of lens member 72.

The particular construction represented by lens assembly 71 differs from that disclosed in FIG. 1 in that it is substantially flat throughout its entirety rather than being convex in nature. Typically, automobile headlamps have a convex outer lens member in order to provide a construction of greater strength for resistance to the internal pressure which builds up inside of the headlamp. Due to the internal pressures which do build up in conventional automobile headlamps, substantially flat outer lens members are not employed. In order to construct the lens of FIG. 1 in the convex shape which is illustrated, the lens is molded of a plastic compound so as to enable low-cost, mass production. One problem associated with the use of plastic for this lens member is that it is of a plastic construction throughout both as to the inner stepped surface 34 as well as the exterior surface 35. Consequently, the lens may be acted upon by various road and insect chemicals as well as being weathered by its exposure to the elements. As these various chemicals and elements act upon the lens member, it becomes scratched, and deteriorates. The result is a loss of incident light. The improved design represented by FIG. 6 is that because of the ambient internal pressure and the expandable membrane, strength requirements are not at issue. Therefore, a substantially flat all glass lens assembly may be employed, and although the inner lens member 72 is typically still of a plastic construction, it is fronted on its exterior or exposed surface by the flat glass cover plate 75. Consequently, it is a glass member rather than plastic which is acted upon by the various chemicals and weather elements, thus enabling the plastic to remain unaffected. The result is a much more durable and lasting headlamp which is able to maintain light intensity and focus throughout its useful life.

Another advantage provided by the use of a substantially flat lens assembly, and in particular the presence of a substantially flat glass cover plate, is that the aiming nodes previously seen in FIG. 1 at points 36 are not required. The aimining nodes of FIG. 1 are included in order to provide a means for establishing a planar surface inasmuch as the lens is convex. If the lens is not convex but rather flat as is disclosed in FIG. 6, then there is no need for aiming nodes in order to establish proper lamp centering and squareness. Since a plane of reference is already provided, the aiming nodes can be eliminated. Consequently, the aiming nodes can be and are eliminated from the embodiment of FIG. 6, and become a part of the aiming fixture.

Figure 4:
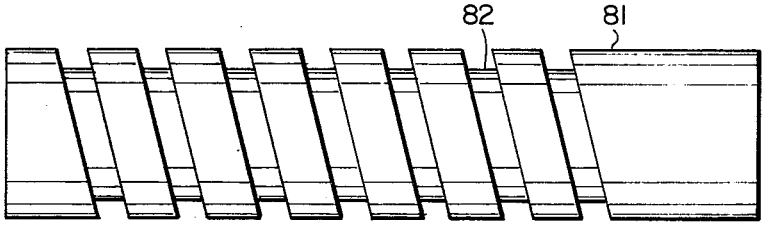
FIG. 4 is a side elevation view of a filament mandrel suitable for use in forming the FIG. 3 filament wire.
Figure 5:
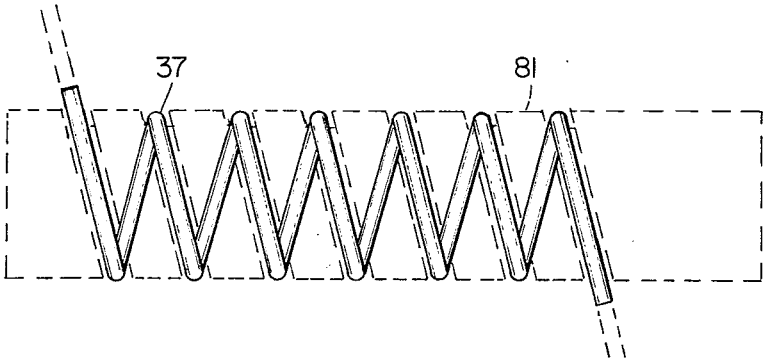
FIG. 5 is a side elevation view of a filament wire wound into a helix on the FIG. 4 filament mandrel.

Referring to FIGS. 4 and 5, the construction and method of fabrication of filament 23 are disclosed in greater detail. As has been previously described, filament 23 includes a tungsten wire 37 and a ceramic core 38. While these are believed to be the preferred materials for the particular lamp, it is to be understood that generally a filament of this nature is fabricated from a refractory metal such as tungsten or a tungsten alloy and that the core 38 is of a refractory compound which is capable of withstanding extremely high heat. Suitable materials for core 38 may include rare oxides or a mixture of rare oxides such as zirconia or magnesia. As is clearly illustrated in FIG. 3, refractory core 38 is configured with a helix-shaped channel 78 which extends for virtually the full length of core 38 with a constant pitch and depth. Tungsten wire 37 is similarly formed with a helix configuration and the coil has an outside diameter which is substantially coincident with the outside diameter of the ceramic core. In order to achieve this end result, it is necessary that the depth of helix channel 78 generally correspond to the diameter of tungsten wire 37. The free ends 79 and 80 of the coiled tungsten wire are provided in order to be secured to support rods 39 and 40 as illustrated in FIG. 2.

In order to facilitate the assembly of the coiled tungsten wire around the refractory core, it is preferred to initially form the tungsten wire by a separate fabrication step and then threadedly insert the core into the coiled wire while retained in the coiling machine. Due to the small size of the core and the coiled wire, it is neither convenient or feasible to attempt to coil the tungsten wire directly around the core. A significantly important aspect of this assembly procedure is that the tungsten wire is stiff and possesses relatively high elasticity. Consequently, coiling the wire directly around the ceramic core would thereafter allow the coiled wire to spring back or out thereby increasing the size of the coil and precluding a coincident cylindrical relationship between the outer diameter of the coil and the outer diameter of the core as illustrated in FIG. 3. Consequently, one method of fabrication of the core and coil assembly is illustrated in part by FIGS. 4 and 5.

FIG. 4 discloses a coil mandrel 81 which includes a helix-shaped channel 82 extending throughout virtually the entire length of the mandrel. The outside diameter of channel 82 is smaller than the outside diameter of channel 78. Therefore, as the tungsten wire is tightly wound around mandrel 81 by placement within channel 82, it has in this restrained condition (see FIG. 5) a smaller diameter than its ultimate end-use size. Next the coiled wire is partially unwound to an expanded diameter size and the mandrel is withdrawn. While the coiled wire is still held in its expanded condition, the core is threadedly inserted. Since the unwound diameter of the wire is slightly larger than the outside diameter of the core, their threaded fit is loose. However, once the wire is released, its spring character and the fact of its earlier forming on the mandrel cause the wire to spring back tightly into channel 82 and around core 38. By separately coiling the segments of tungsten wire on mandrels such as mandrel 81 and thereafter threadedly inserting the cores into the individual segments of coiled tungsten wire, the entire filament fabrication procedure can be automated and is both reliable and low-cost.

FIG. 7 is provided as an illustration of a front-on view of ambient pressure lamp 20. Due to the fact that the convex nature of lens 22 of FIG. 1 geometrically projects as a flat circular plate, FIG. 7 is representative of both ambient pressure lamp as well as ambient pressure lamp 70. The sole difference between these two embodiments relative to the illustration of FIG. 7 is that nodes 36 are provided in FIG. 7, but such nodes are not part of ambient pressure lamp 70. The front center portion of lens 22 is broken away in order to illustrate the centralized location and the orientation of filament 23.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An ambient pressure lamp comprising:

a reflector member having an inner reflective surface, an outer surface, a base portion and an outer peripheral edge;

an enclosing cover member having an outer peripheral lip portion, said lip portion being assembled to said outer peripheral edge so as to define an inner chamber between said inner reflective surface and said enclosing cover member;

a lamp filament;

a lamp socket assembled to said reflector member adjacent said base portion and cooperatively adapted for receipt of said lamp filament; and an expandable membrane sealingly joined around said outer surface and around said filament socket so as to define an expansion chamber between said outer surface and said expandable membrane, said expansion chamber being completely enclosed except for being in flow communication with said inner chamber.

2. The ambient pressure lamp of claim 1 wherein said lamp filament includes a coiled tungsten wire disposed about a refractory core.

3. The ambient pressure lamp of claim 2 wherein said refractory core includes a helix channel disposed therein, the depth of said helix channel generally corresponding to the diameter of said tungsten wire so that the outermost surfaces of said refractory core and said coiled tungsten wire are substantially coincident.

4. The ambient pressure lamp of claim 1 wherein said base portion includes a centrally located clearance aperture and said filament socket is adapted to slidably fit within said clearance aperture for focusing purposes.

5. The ambient pressure lamp of claim 1 wherein said filament socket includes a pair of purge/fill passageways, one of said passageways being disposed in flow communication with said expansion chamber, the other of said passageways being disposed in flow communication with said inner chamber.

6. The ambient pressure lamp of claim 1 wherein said enclosing cover member is convex in shape having a stepped inner surface and an outer surface, said outer surface having a plurality of aiming nodes.

7. The ambient pressure lamp of claim 1 wherein said enclosing cover member includes a lens member having a stepped inner surface and a substantially flat outer surface and joined to said outer surface a substantially flat glass cover plate.

8. The ambient pressure lamp of claim 7 wherein said flat glass cover plate is free of an aiming nodes yet provides a planar reference surface for aiming purposes.

9. An ambient pressure lamp comprising:

a parabolic reflector member having a rear surface and an inner reflective surface;

an enclosing cover member assembled to said parabolic reflector member so as to define an inner chamber, said enclosing cover member having a substantially flat lens portion and assembled thereto a substantially flat glass cover plate;

a lamp filament assembly including a lamp filament which is disposed within said inner chamber; and an expandable membrane sealingly joined around the rear surface of said parabolic reflector member so as to define an expansion chamber between said rear surface and said expandable membrane, said expansion chamber being completely enclosed except for being in low communication with said inner chamber.

10. The ambient pressure lamp of claim 9 wherein the position of said lamp filament relative to said parabolic reflector member is initially adjustable.

* * * * *